US010131145B2

(12) United States Patent
Irokawa

(10) Patent No.: US 10,131,145 B2
(45) Date of Patent: Nov. 20, 2018

(54) EJECTION HOLE PLATE, LIQUID EJECTION HEAD, AND LIQUID EJECTION APPARATUS

(71) Applicant: SII Printek Inc., Chiba-shi, Chiba (JP)

(72) Inventor: Daiki Irokawa, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/702,221

(22) Filed: Sep. 12, 2017

(65) Prior Publication Data

US 2018/0086062 A1 Mar. 29, 2018

(30) Foreign Application Priority Data

Sep. 29, 2016 (JP) ..... 2016-191713

(51) Int. Cl.
*B41J 2/14* (2006.01)
*B41J 2/16* (2006.01)

(52) U.S. Cl.
CPC ..... *B41J 2/1433* (2013.01); *B41J 2/16* (2013.01)

(58) Field of Classification Search
CPC ..... B41J 2/1433; B41J 2/135; B41J 2/2125; B41J 2/16
USPC ..... 347/20, 44, 47
See application file for complete search history.

(56) References Cited

U.S. PATENT DOCUMENTS

| | | | |
|---|---|---|---|
| 2006/0061622 | A1 | 3/2006 | Suzuki |
| 2008/0062235 | A1 | 3/2008 | Nielsen et al. |
| 2011/0018936 | A1 | 1/2011 | McAvoy et al. |
| 2013/0027470 | A1 | 1/2013 | Kato et al. |

FOREIGN PATENT DOCUMENTS

| | | | |
|---|---|---|---|
| EP | 1 447 221 | A1 | 8/2004 |
| JP | 2006-272614 | A | 10/2006 |

OTHER PUBLICATIONS

Extended European Search Report in European Application No. 17192991.2, dated Feb. 22, 2018, 7 pages.

*Primary Examiner* — An Do
(74) *Attorney, Agent, or Firm* — Brinks Gilson & Lione

(57) ABSTRACT

The present invention relates to a nozzle plate having small-diameter nozzle holes and large-diameter nozzle holes that are larger in diameter than the small-diameter nozzle holes and communicate with the small-diameter nozzle holes on the downstream side along the direction of ink flow.

6 Claims, 5 Drawing Sheets

EJECTION HOLE PLATE, LIQUID EJECTION HEAD, AND LIQUID EJECTION APPARATUS

RELATED APPLICATIONS

This application claims priority under 35 U.S.C. § 119 to Japanese Patent Application No. 2016-191713 filed on Sep. 29, 2016, the entire content of which is hereby incorporated by reference.

BACKGROUND OF THE INVENTION

Technical Field

The present invention relates to an ejection hole plate, a liquid ejection head, and a liquid ejection apparatus.

Related Art

Provided is an inkjet printer including an inkjet head as an apparatus that discharges ink droplets onto a recording medium (for example, recording paper or the like) to record information (for example, images, characters, and the like) on the recording medium. The inkjet head has an actuator plate with channels charged with an ink and a nozzle plate with nozzle holes communicating with the channels. In the inkjet head, the actuator plate deforms in such a manner to increase and decrease the volume of the channels to discharge the ink charged in the channels through the nozzle holes.

For example, JP 2006-272614 A discloses a configuration in which a nozzle plate is formed with large-diameter nozzle holes and small-diameter holes smaller in diameter than the large-diameter nozzle holes. The large-diameter nozzle holes and the small-diameter nozzle holes are alternately arranged in the nozzle plate in the direction of channel arrangement, for example. The large-diameter nozzle holes and the small-diameter nozzle holes communicate with different channels.

According to this configuration, ink is discharged from the large-diameter nozzle holes and the small-diameter nozzle holes so that large ink droplets are discharged from the large-diameter nozzle holes and small ink droplets are discharged from the small-diameter nozzle holes. This makes it possible to discharge ink droplets of different sizes in the same color and record information with a wide variety of gradations.

SUMMARY OF THE INVENTION

There have been recently studied configurations for changing the sizes of ink droplets discharged from the inkjet head for different purposes (for example, high-speed printing, high-resolution printing, and the like). In one of the possible configurations, switching takes place between a small droplet mode in which ink is discharged from the small-diameter nozzle holes and large droplet mode in which ink is discharged from the large-diameter nozzle holes.

According to the foregoing configuration described in JP 2006-272614 A, however, the large-diameter nozzle holes and the small-diameter nozzle holes are alternately formed, the pitches of the same-diameter nozzle holes are wider as compared to the case in which only the nozzle holes of the same diameter are arranged. Accordingly, there is a limit to the extent to which the pitches of droplets during printing is narrowed, thereby making it hard to improve the resolution.

In addition, the surface tension (meniscus strength) acting on the inner surfaces of the nozzle holes varies depending on the inner diameters of the nozzle holes. Accordingly, when a plurality of nozzle holes with different inner diameters is formed in the same plane of the nozzle plate, it is difficult to form proper menisci in the nozzle holes. Further, there is a limit to the extent to which the difference in inner diameter between the small-diameter nozzle holes and the large-diameter nozzle holes is increased to form proper menisci in the nozzle holes in the same plane of the nozzle plate. As a result, it is difficult to increase the difference in droplet size between the small droplet mode and the large droplet mode.

The present invention is devised in light of the foregoing circumstances. An object of the present invention is to provide an ejection hole plate, a liquid ejection head, and a liquid ejection apparatus with excellent product appeal that allow changing of the droplet sizes for different purposes.

To achieve the foregoing object, an ejection hole plate according to an aspect of the present invention includes a plate main body with first ejection holes and second ejection holes configured to eject a liquid, and the second ejection holes are larger in diameter than the first ejection holes and communicate with the first ejection holes on a downstream side of the first ejection holes in a direction of liquid flow.

According to this configuration, the size of droplets ejected from the liquid ejection head can be changed by altering the pressure of the liquid in the channels communicating upstream with the ejection holes, for example. That is, this aspect makes it possible to switch between the small droplet mode in which small droplets are ejected, with menisci formed in the first ejection holes and the large droplet mode in which large droplets are ejected, with menisci formed in the second ejection holes. In this case, the print range with one droplet in the small droplet mode can be made smaller than that in the large droplet mode. Accordingly, increasing the drive frequency in the small droplet mode more than that in the large droplet mode makes it possible to narrow the pitch of the droplets in the scanning direction of the liquid ejection head, thereby achieving high-resolution printing. Meanwhile, the print range with one droplet in the large droplet mode can be made larger than that in the small droplet mode, thereby achieving high-speed printing. Switching between the small droplet mode and the large droplet mode according to the pressure in the channels, for example, makes it easy to change the droplet size of the liquid discharged from the liquid ejection head for different purposes.

In this aspect, especially, the first ejection holes and the second ejection holes communicate with each other in the direction of liquid flow, whereby the pitches of the same-diameter ejection holes adjacent to each other can be easily narrowed as compared to the case where the first ejection holes and the second ejection holes are alternately formed in the same plane of the plate main body. This makes it possible to narrow the pitch of droplets in the alignment direction of the ejection holes and improve the resolution.

In addition, the ejection hole plate of this aspect has the same-diameter ejection holes in the same plane of the plate main body. This makes it easier to form optimum menisci in the individual ejection holes as compared to the case where a plurality of ejection holes with different inner diameters is formed in the same plane. Further, since the optimum menisci can be easily formed in the ejection holes, it is possible to secure the difference in inner diameter between the first ejection holes and the second ejection holes and increase the difference in droplet size between the small droplet mode and the large droplet mode.

In the foregoing aspect, the plate main body may have hydrophilic connection surfaces configured to connect downstream end edges of the first ejection holes along the flow direction and upstream end edges of the second ejection holes along the flow direction.

According to the foregoing aspect, when switching takes place from the small droplet mode to the large droplet mode, the liquid overflowing from the first ejection holes can be spread onto the connection surfaces. This suppresses the drop of the ink overflowing from the first ejection holes directly to the outside through the second ejection hole (without spreading onto the connection surfaces or the inner surfaces of the second ejection holes). As a result, the second ejection holes can be filled with the liquid in the large droplet mode.

In the foregoing aspect, the plate main body may have a water-repellent opening surfaces provided with downstream openings of the second ejection holes along the flow direction.

According to the foregoing aspect, it is possible to suppress the spread of the liquid on the opening surfaces, thereby suppressing the overflow of the liquid from the second ejection holes when switching takes place from the small droplet mode to the large droplet mode, for example.

In the foregoing aspect, the plate main body may include: a first plate having the first ejection holes; and a second plate stacked on a downstream side of the first plate along the flow direction and having the second ejection holes.

According to the foregoing aspect, after the formation of the first ejection holes and the second ejection holes in the respective plates, the plates can be stacked to form the ejection hole plate. Accordingly, the ejection hole plate can be manufactured more easily as compared to the case where the first ejection holes and the second ejection holes are aligned in the flow direction in one plate.

In the foregoing aspect, the plate main body may have an intermediate plate interposed between the first plate and the second plate, the intermediate plate may have communication holes configured to allow downstream openings of the first ejection holes along the flow direction and upstream openings of the second ejection holes along the flow direction to communicate with each other, and an inner diameter of the communication holes may be equal to or more than an inner diameter of the second ejection holes.

According to the foregoing aspect, the menisci of the liquid formed by the interaction (surface tension or the like) with the inner surfaces of the second ejection holes can be accommodated in the second ejection holes (and the communicating holes). That is, since the liquid levels of the menisci can be arranged in the second ejection holes (and the communicating holes), it is possible to suppress the situation in which the menisci formed in the second ejection holes cannot be accommodated within the second ejection holes and the menisci are broken. This allows stable formation of the proper menisci in the second ejection holes.

In addition, the communicating holes allow the downstream openings of the first ejection holes and the upstream openings of the second ejection holes to communicate with each other, the communicating holes are also filled with the liquid in the large droplet mode. In this case, the inner diameter of the communicating holes is equal to or larger than the inner diameter of the second ejection holes, which makes it possible to flow the liquid in the second ejection holes more smoothly as compared to the case where the liquid from the first ejection holes smaller in diameter than the second ejection holes flows directly into the second ejection holes. That is, the communicating holes act as buffers to hold the liquid between the first ejection holes and the second ejection holes, thereby to suppress an insufficient supply of the liquid to the second ejection holes in the large droplet mode.

In the foregoing aspect, a length of the second ejection holes along the flow direction may be larger than a length of the first ejection holes along the flow direction.

According to the foregoing aspect, the menisci of the liquid formed by interaction (surface tension or the like) with the inner surfaces of the second ejection holes can be accommodated in the second ejection holes. That is, since the liquid levels of the menisci can be arranged in the second ejection holes, it is possible to suppress the situation in which the menisci formed in the second ejection holes cannot be accommodated within the second ejection holes and the menisci are broken. This allows stable formation of the proper menisci in the second ejection holes.

A liquid ejection head according to an aspect of the present invention includes: the ejection hole plate according to the foregoing aspect; and an actuator plate disposed on an upstream side of the ejection hole plate along the flow direction and having channels configured to communicate with the second ejection holes through the first ejection holes.

According to the foregoing aspect, including the ejection hole plate makes it possible to provide the liquid ejection head with excellent product appeal.

A liquid ejection apparatus according to an aspect of the present invention includes the liquid ejection head according to the foregoing aspect.

According to the foregoing aspect, including the liquid ejection head makes it possible to provide the liquid ejection apparatus with excellent product appeal.

According to one aspect of the present invention, it is possible to provide an ejection hole plate, a liquid ejection head, and a liquid ejection apparatus with excellent product appeal that allow changing of the droplet sizes for different purposes.

DETAILED DESCRIPTION OF THE PREFERRED EMBODIMENTS

Figure 1:
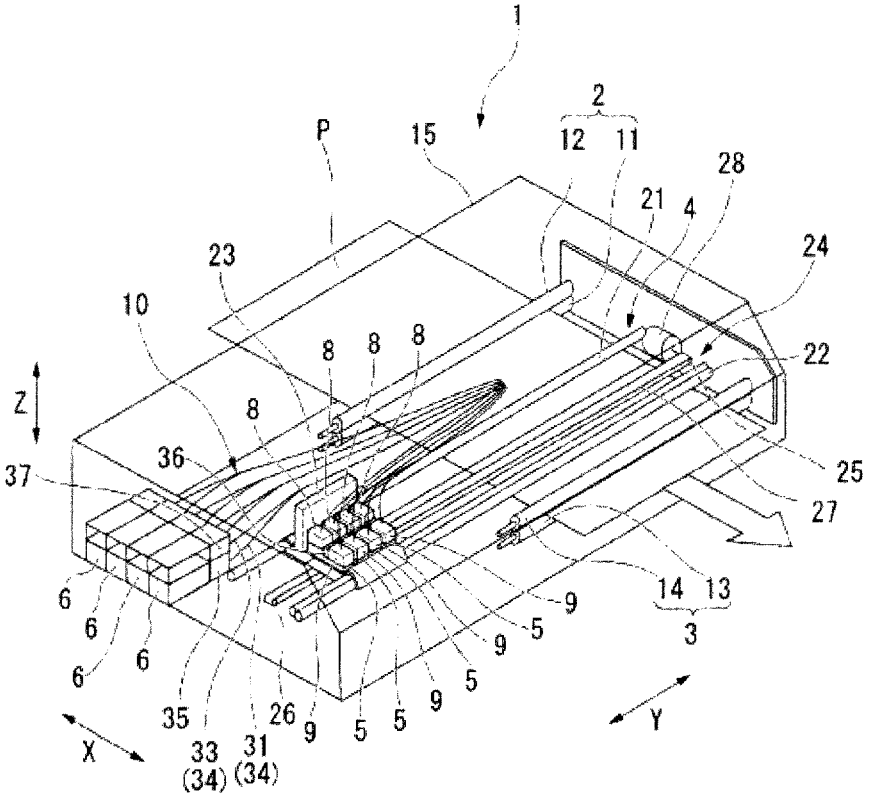
FIG. 1 is a schematic configuration diagram of an inkjet printer according to an embodiment.

Embodiments of the present invention will be described below with reference to the drawings. In the following description of the embodiments, an inkjet printer (hereinafter, simply called printer) for making records on a recording medium using an ink (liquid) will be taken as an example. In the drawings referred to in the following description, the members are scaled as appropriate so that the members can be illustrated in recognizable sizes.

First Embodiment

[Printer]

FIG. 1 is a schematic configuration diagram of a printer 1.

As illustrated in FIG. 1, the printer 1 of the embodiment is configured in such a manner that a pair of conveying mechanisms 2 and 3, a scanning mechanism 4, inkjet heads 5, main tanks 6, sub tanks 8 and 9, ink circulation mechanisms 10, and others are stored in a housing 15.

In the following description, an orthogonal coordinate system of X, Y, and Z will be used as necessary. In this case, an X direction is aligned to the direction in which a recording medium P (for example, paper or the like) is conveyed, a Y direction is aligned to the direction in which the scanning mechanism 4 scans, and a Z direction is orthogonal to the X direction and the Y direction. The printer 1 of the embodiment is placed in such a manner that the X direction and the Y direction are horizontal direction and the Z direction is the gravity direction.

The conveying mechanisms 2 and 3 convey the recording medium P in the X direction. Specifically, the conveying mechanism 2 includes a grit roller 11 extended in the Y direction, a pinch roller 12 extended in parallel to the grit roller 11, and a driving mechanism (not illustrated) such as a motor for axially rotating the grit roller 11. The conveying mechanism 3 includes a grit roller 13 extended in the Y direction, a pinch roller 14 extended in parallel to the grit roller 13, and a driving mechanism (not illustrated) for axially rotating the grit roller 13.

The scanning mechanism 4 reciprocates the inkjet heads 5 for scanning in the Y direction. Specifically, the scanning mechanism 4 includes a pair of guide rails 21 and 22 extended in the Y direction, a carriage 23 movably supported by the pair of guide rails 21 and 22, and a driving mechanism 24 moving the carriage 23 in the Y direction.

The driving mechanism 24 is interposed between the guide rails 21 and 22 in the X direction. The driving mechanism 24 includes a pair of pulleys 25 and 26 spaced in the Y direction, an endless belt 27 wound around the pair of pulleys 25 and 26, and a driving motor 28 rotationally driving the pulley 25.

The carriage 23 is coupled to the endless belt 27. The carriage 23 is loaded with the plurality of inkjet heads 5 aligned in the Y direction.

The inkjet heads 5 are configured to discharge inks of different colors such as yellow, magenta, cyan, and black, for example.

The main tanks 6 are provided separately from the inkjet heads 5 (carriage 23) in the housing 15. The main tanks 6 are aligned in the X direction in the housing 15. The main tanks 6 contain the inks of different colors corresponding to the inkjet heads 5 described above.

The sub tanks 8 and 9 are loaded together with the inkjet heads 5 in the carriage 23. The sub tanks 8 and 9 are respectively supply sub tanks 8 for supplying the inks to the inkjet heads 5 and exhaust sub tanks 9 for containing the inks exhausted from the inkjet heads 5. The supply sub tanks 8 and the exhaust sub tanks 9 are provided in the inkjet heads 5. Therefore, the supply sub tanks 8 and the exhaust sub tanks 9 contain the inks of the colors corresponding to the colors of the inkjet heads 5.

Figure 2:
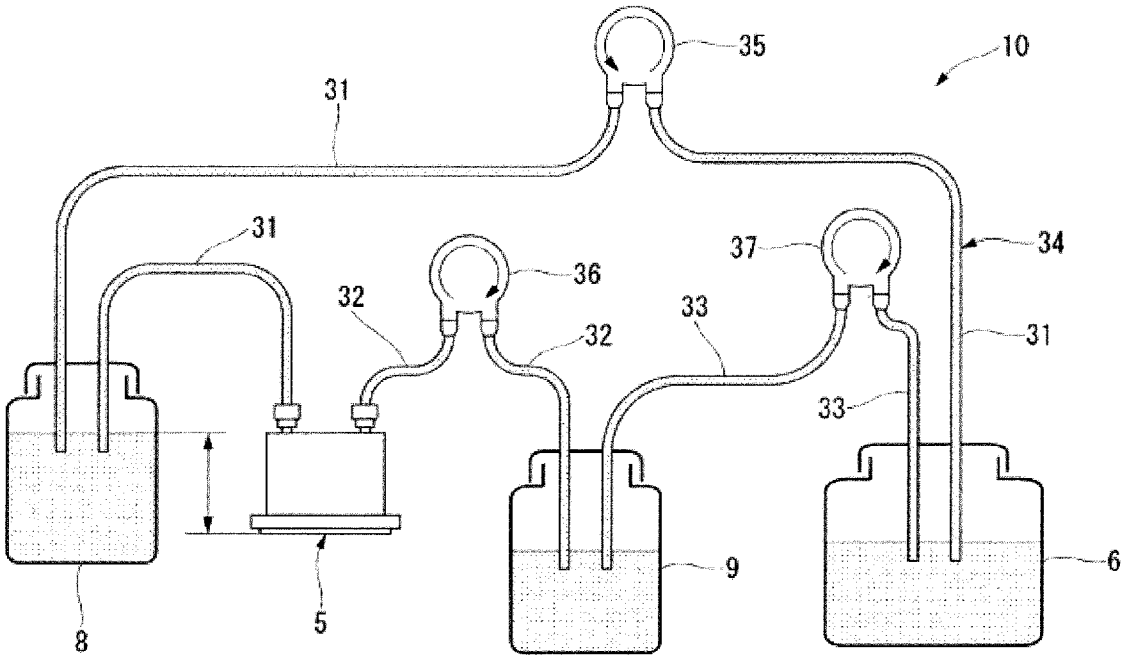
FIG. 2 is a schematic configuration diagram of an inkjet head, a main tank, sub tanks, and an ink circulation mechanism according to a first embodiment.

FIG. 2 is the schematic configuration diagram of the inkjet head 5, the main tank 6, the sub tanks 8 and 9, and the ink circulation mechanism 10. The inkjet heads 5, the main tanks 6, the sub tanks 8 and 9, and the ink circulation mechanism 10 are all the same in configuration except for the colors of the supplied inks. Accordingly, in the following description, one inkjet head 5, one main tank 6, one sub tank 8, one sub tank 9, and one ink circulating mechanism 10 will be taken as an example.

As illustrated in FIG. 2, the ink circulation mechanism 10 includes a circulation flow path 34 having an ink supply tube 31, an ink exhaust tube 32, and an ink collection tube 33, a supply pump 35, a suction pump 36, and a collection pump 37.

The ink supply tube 31 connects between the main tank 6 and the supply pump 35, between the supply pump 35 and the supply sub tank 8, and between the supply sub tank 8 and the inkjet head 5.

The ink exhaust tube 32 connects between the inkjet head 5 and the suction pump 36 and between the suction pump 36 and the exhaust sub tank 9.

The ink collection tube 33 connects between the exhaust sub tank 9 and the collection pump 37 and between the collection pump 37 and the main tank 6.

The supply pump 35 sends the ink in the main tank 6 to the supply sub tank 8 through the ink supply tube 31.

The suction pump 36 sends the ink in the inkjet head 5 to the exhaust sub tank 9 through the ink exhaust tube 32.

The collection pump 37 sends the ink in the exhaust sub tank 9 to the main tank 6 through the ink collection tube 33. In the embodiment, the pumps 35 to 37 are tube pumps.

<Inkjet Head>

Figure 3:
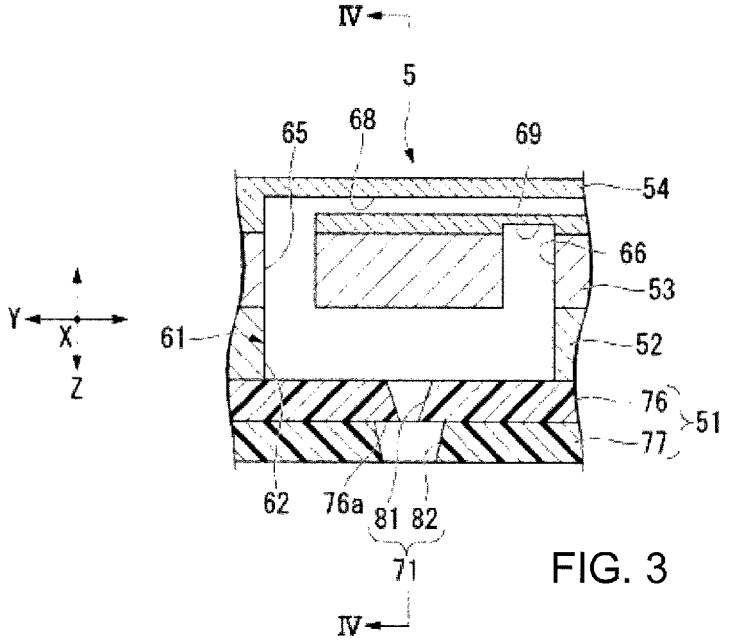
FIG. 3 is a schematic cross-sectional view of the inkjet head according to the first embodiment.
Figure 4:
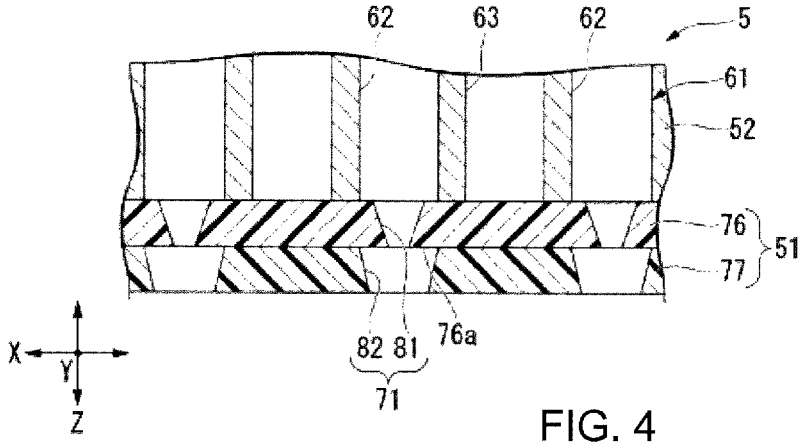
FIG. 4 is a cross-sectional view of FIG. 3 taken along line IV-IV.

FIG. 3 is a schematic cross-sectional view of the inkjet head 5. FIG. 4 is a cross-sectional view of FIG. 3 taken along line IV-IV.

As illustrated in FIGS. 3 and 4, the inkjet head 5 is a side-shoot type with an ink circulation mechanism, in which an ink is discharged from Y-direction centers of discharge channels 62 described later. Specifically, the inkjet head 5 includes a nozzle plate 51, an actuator plate 52, a cover plate 53, and a flow path plate 54. The nozzle plate 51, the actuator plate 52, the cover plate 53, and the flow path plate 54 are stacked in this order in the Z direction. In the following description, in the inkjet head 5, the nozzle plate 51 side is set on the lower side along the Z direction, and the flow path plate 54 side is set on the upper side along the Z direction.

The inkjet head 5 is loaded on the carriage 23 (see FIG. 1) such that the nozzle plate 51 faces downward. Accordingly, the individual inkjet heads 5 are configured to discharge droplets downward.

The actuator plate 52 is foamed from a piezoelectric material such as lead zirconate titanate (PZT). The actuator plate 52 includes a monopole-type substrate in which the direction of polarization is set to one along the Z direction. Alternatively, the actuator plate 52 may include a chevron-type substrate in which two piezoelectric substrates different in the direction of polarization in the Z direction are stacked.

The actuator plate 52 has a channel array 61. The channel array 61 includes discharge channels 62 to be filled with an ink and non-discharge channels 63 not to be filled with an ink (see FIG. 4). The channel array 61 is configured such that the discharge channels 62 and the non-discharge channels 63 are alternately spaced in the X direction.

The channels 62 and 63 extend longitudinally in the Y direction, and at least some of them penetrate through the actuator plate 52 in the Z direction. Drive electrodes (not illustrated) are formed on inner surfaces of the channels 62 and 63. In the embodiment, the number of the channel array 61 is one, but the present invention is not limited to this configuration. That is, two channel arrays 61 may be spaced in the Y direction. In this case, the discharge channels 62 and the non-discharge channels 63 of the channel arrays 61 are preferably arranged in a staggered pattern. However, the respective pitches of the channels 62 and 63 can be changed as appropriate. In addition, three or more channel arrays 61 may be provided.

As illustrated in FIG. 3, the cover plate 53 is bonded to the upper surface of the actuator plate 52 in such a manner to close the channels 62 and 63. The cover plate 53 has an entrance opening 65 and an exit opening 66 communicating with the discharge channels 62. These openings penetrate through the cover plate 53 in the Z direction.

The entrance opening 65 communicates with first ends of the discharge channels 62 in the Y direction. The exit opening 66 communicates with second ends of the discharge channels 62 in the Y direction. The openings 65 and 66 may be formed in the individual discharge channels 62. The openings 65 and 66 may be formed to communicate collectively with the discharge channels 62.

The flow path plate 54 is bonded to the upper surface of the cover plate 53 in such a manner as to close the openings 65 and 66. The flow path plate 54 has a supply flow path 68 and an exhaust flow path 69. The supply flow path 68 communicates with the discharge channels 62 through the entrance openings 65. The supply flow path 68 connects to the downstream end of the ink supply tube 31 (see FIG. 2). The exhaust flow path 69 communicates with the discharge channels 62 through the exit openings 66. The exhaust flow path 69 connects to the upstream end of the ink exhaust tube 32.

Figure 5:
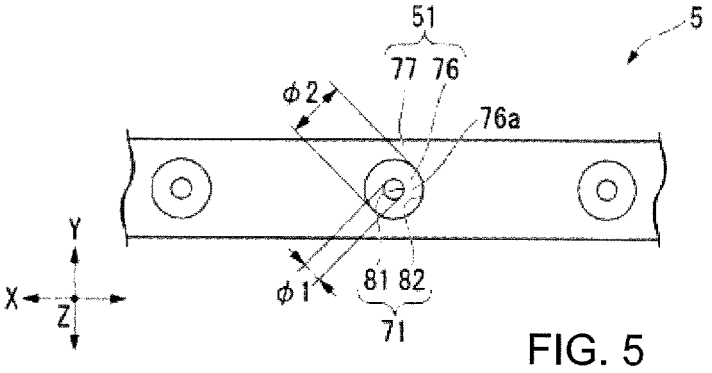
FIG. 5 is a bottom view of a nozzle plate seen from below according to the first embodiment.

FIG. 5 is a bottom view of the nozzle plate 51 seen from below.

As illustrated in FIGS. 4 and 5, the nozzle plate 51 is bonded to the lower surface of the actuator plate 52 in such a manner as to close the channels 62 and 63 from below. The nozzle plate 51 has a plurality of nozzle holes 71 penetrating through the nozzle plate 51 in the Z direction. The nozzle holes 71 are spaced in the X direction at the same pitch as that of the discharge channels 62. The nozzle holes 71 individually communicate with the discharge channels 62. As illustrated in FIG. 3, the nozzle holes 71 are positioned in the nozzle plate 51 at the Y-direction centers of the corresponding discharge channels 62.

The nozzle plate 51 of the embodiment (ejection hole plate and plate main body) is formed by stacking two plates 76 and 77 in the Z direction. Specifically, the nozzle plate 51 has the first plate 76 and the second plate 77 bonded to the lower surface of the first plate 76. The plates 76 and 77 are formed from a hydrophilic material (for example, polyimide). The plates 76 and 77 may be formed from a metallic material (SUS or the like), glass, or the like. In addition, the plates 76 and 77 may have a stacked structure of different materials.

The nozzle holes 71 penetrate through the plates 76 and 77 in the Z direction. The nozzle holes 71 are configured such that small-diameter nozzle holes 81 and large-diameter nozzle holes 82 are lined in the Z direction (the direction of ink flow). Specifically, the small-diameter nozzle holes 81 penetrate through the first plate 76 in the Z direction. The small-diameter nozzle holes 81 are tapered such that the inner diameter gradually reduces in the downward direction. In the embodiment, an inner diameter $\phi 1$ of the lower end openings of the small-diameter nozzle holes 81 is about 10 to 30 μm, for example.

The large-diameter nozzle holes 82 penetrate through the second plate 77 in the Z direction. The large-diameter nozzle holes 82 communicate with the small-diameter nozzle holes 81 through the upper end openings. In the embodiment, the large-diameter nozzle holes 82 are coaxial with the small-diameter nozzle holes 81. The large-diameter nozzle holes 82 are tapered such that the inner diameter gradually reduces in the downward direction. The centers of the large-diameter nozzle holes 82 may be slightly shifted from the centers of the small-diameter nozzle holes 81 in the X direction and the Y direction.

In the embodiment, an inner diameter $\phi 2$ of the lower end openings of the large-diameter nozzle holes 82 is about 25 to 50 for example. The dimensions of the nozzle holes 81 and 82 can be changed as appropriate as far as menisci can be formed in the nozzle holes 81 and 82 by interaction (surface tension or the like) with the inner surfaces of the nozzle holes 81 and 82. For example, the inner diameter of the upper end openings of the large-diameter nozzle holes 82 may be larger than the X-direction width of the discharge channels 62.

In the embodiment, the thickness of the second plate 77 (the Z-direction length of the large-diameter nozzle holes 82) is larger than the thickness of the first plate 76 (the Z-direction length of the small-diameter nozzle holes 81). In this case, the thickness of the second plate 77 (for example, about 50 μm) is preferably set to be equal to or larger than the radius of the lower end opening of the large-diameter nozzle hole 82 (that is, equal to or larger than the maximum Z-direction recess amount of the meniscus formed in the large-diameter nozzle hole 82). In the embodiment, the term "recess amount" means the Z-direction distance of the top of the liquid level of the meniscus and the lower end opening edge of the large-diameter nozzle hole 82. However, the thicknesses of the plates 76 and 77 can be changed as appropriate.

In the embodiment, the lower surface of the second plate 77 is subjected to water-repellent (liquid-repellent) treatment. As described above, the plates 76 and 77 are formed from a hydrophilic material. Accordingly, the portions other than the lower surface of the second plate 77 (for example, the portion in the lower surface of the first plate 76 exposed to the large-diameter nozzle holes 82 (connection surfaces 76*a* between the upper edges of the large-diameter nozzle holes 82 and the lower edges of the small-diameter nozzle holes 81) and inner surfaces of the nozzle holes 81 and 82) remain hydrophilic.

The nozzle plate 51 of the embodiment can be manufactured by bonding together the first plate 76 with the small-diameter nozzle holes 81 and the second plate 77 with the large-diameter nozzle holes 82. In this case, the nozzle holes 81 and 82 can be formed by laser processing or etching, for example.

[Method for Operating the Printer]

Next, a method for recording information on the recording medium P using the foregoing printer 1 will be explained. In the following description, inks of different colors are sufficiently stored in the main tanks 6 and the sub tanks 8 and 9 illustrated in FIG. 1 as an initial state. In addition, inks are charged in the inkjet heads 5 as well.

In the initial state, when the printer 1 illustrated in FIG. 1 is activated, the grit rollers 11 and 13 in the conveying mechanisms 2 and 3 rotate to convey the recording medium P between the grit rollers 11 and 13 and the pinch rollers 12 and 14 in the X direction. At the same time, the driving motor 28 rotates the pulley 25 to run the endless belt 27. Accordingly, the carriage 23 reciprocates in the Y direction while being guided by the guide rails 21 and 22.

<Method for Operating Inkjet Head>

Subsequently, operations of the inkjet head 5 will be described below in details.

In the circulation side shoot-type inkjet head 5 as described in the embodiment, the supply pump 35, the suction pump 36, and the collection pump 37 are activated to flow an ink in the circulation flow path 34. Specifically, the ink stored in the main tank 6 is supplied to the supply sub tank 8 through the ink supply tube 31. After that, the ink supplied to the supply sub tank 8 is then supplied to the inkjet head 5 through the ink supply tube 31. The ink is supplied from the supply sub tank 8 to the inkjet head 5 by the water head difference between the supply sub tank 8 and the exhaust sub tank 9.

As illustrated in FIG. 3, the ink supplied to the inkjet head 5 is supplied to the discharge channels 62 through the supply flow path 68 and the entrance opening 65. Then, the ink passes through the discharge channels 62 and flows into the ink exhaust tube 32 (see FIG. 2) through the exit opening 66 and the exhaust flow path 69. The ink having flown into the ink exhaust tube 32 is exhausted to the exhaust sub tank 9. The ink is exhausted from the inkjet head 5 to the exhaust sub tank 9 by the water head difference between the supply sub tank 8 and the exhaust sub tank 9 and the operation of the suction pump 36.

When the amount of the ink exhausted to the exhaust sub tank 9 exceeds a predetermined amount, the ink is absorbed by the collection pump 37. The ink absorbed by the collection pump 37 is returned to the main tank 6 through the ink collection tube 33. Accordingly, the ink is circulated between the inkjet head 5 and the main tank 6.

While the ink is circulated between the inkjet head 5 and the main tank 6 and the carriage 23 reciprocates and scans, the inkjet head 5 discharges the ink onto the recording medium P. That is, when a drive voltage is applied to the drive electrodes of the channels 62 and 63, the actuator plate 52 deforms by thickness shear deformation so as to expand and contract the discharge channels 62. By this operation, the pressure in the discharge channels 62 increases to pressurize the ink. As a result, the droplets are discharged to the outside through the nozzle holes 71. The discharged ink lands on the recording medium P to record various kinds of information on the recording medium P.

<Method for Changing Droplet Size>

In the inkjet head 5 of the embodiment, the droplet size of the ink to be discharged from the inkjet head 5 can be changed by altering the pressure in the discharge channels 62. The inkjet head 5 of the embodiment has a small droplet mode for discharging small droplets and a large droplet mode for discharging larger droplets than the small droplet mode. The following description is based on the assumption that the small droplet mode is set. In addition, the small droplet mode and the large droplet mode are switched by the home position of the carriage 23 (the position outside the upper part (printing part) of the recording medium P) or the like.

Figure 6:
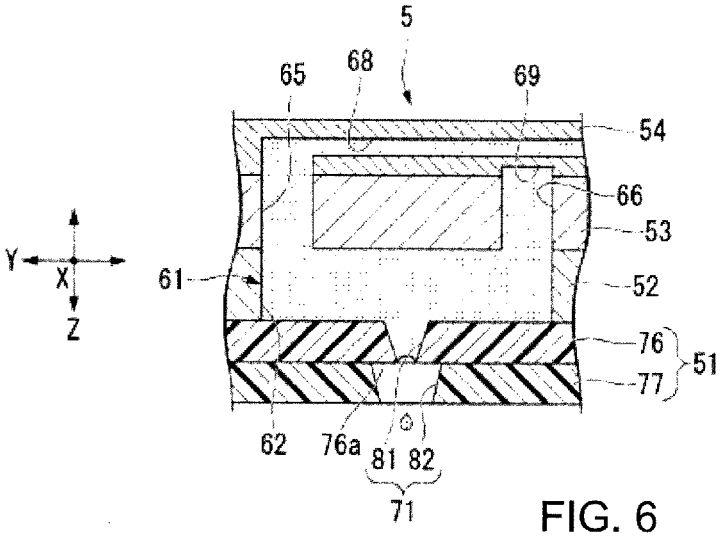
FIG. 6 is a schematic configuration diagram for describing a small droplet mode in correspondence with FIG. 3.

FIG. 6 is a schematic configuration diagram for describing the small droplet mode in correspondence with FIG. 3.

As illustrated in FIG. 6, in the small droplet mode, a proper meniscus is formed in the small-diameter nozzle hole 81 (hereinafter, called small-diameter meniscus) by the surface tension or the like acting in the inner surface of the small-diameter nozzle hole 81. That is, in the small droplet mode, the pressure in the discharge channels 62 is kept at a proper negative pressure (hereinafter, called small-diameter pressure) by the water head difference between the supply sub tank 8 and the exhaust sub tank 9, for example. In this state, the insides of the discharge channels 62 are expanded and contracted by the method for operating the inkjet head 5 described above to release the ink from the small-diameter meniscus. Accordingly, a small droplet of the size corresponding to the small-diameter meniscus drops downward. The small droplet released from the small-diameter meniscus passes through the large-diameter nozzle hole 82 and is discharged from the nozzle hole 71 to the outside. In the small droplet mode, a drive voltage of proper frequency is applied to the drive electrodes so that proper small-diameter meniscus can be formed in the small-diameter nozzle hole 81 before and after discharge of the small droplet.

Figure 7:
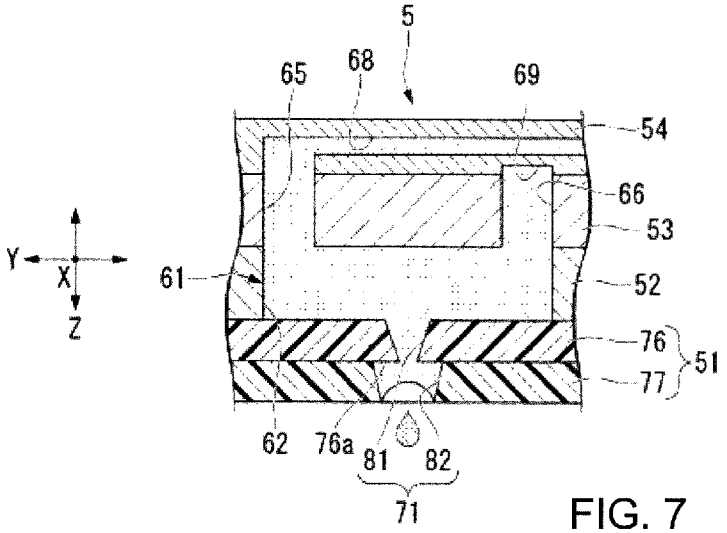
FIG. 7 is a schematic configuration diagram for describing a large droplet mode in correspondence with FIG. 3.

FIG. 7 is a schematic configuration diagram for describing the large droplet mode in correspondence with FIG. 3.

As illustrated in FIG. 7, in the large droplet mode, a proper meniscus is formed in the large-diameter nozzle hole 82 (hereinafter, called large-diameter meniscus). To switch from the small droplet mode to the large droplet mode, the pressure in the discharge channels 62 is increased from the small-diameter pressure in the small droplet mode to the large-diameter pressure in the large droplet mode. The pressure in the discharge channels 62 can be increased by the method described below, for example. That is, the suction pump 36 provided in the ink exhaust tube 32 is stopped to shut off the flow of the ink in the ink exhaust tube 32. At that time, even though the flow of the ink in the ink exhaust tube 32 is shut off, the ink is continuously supplied to the inkjet head 5 by the water head difference between the supply sub tank 8 and the exhaust sub tank 9. Accordingly, the insides of the discharge channels 62 are pressurized.

When the insides of the discharge channels 62 are pressurized, the small-diameter meniscus formed in the small-diameter nozzle hole 81 is broken. When the small-diameter meniscus is broken, the ink enters the large-diameter nozzle hole 82 through the lower end opening of the small-diameter nozzle hole 81 (the upper end opening of the large-diameter nozzle hole 82). The ink having entered the large-diameter nozzle hole 82 spreads on the connection surface 76*a* of the first plate 76. After that, the ink continues to enter the large-diameter nozzle hole 82 to fill the large-diameter nozzle hole 82 with the ink. Then, when the pressure in the discharge channels 62 reaches the large-diameter pressure (negative pressure), a proper large-diameter meniscus is formed in the large-diameter nozzle hole 82 by the surface tension or the like acting on the inner surface of the large-diameter nozzle hole 82. In the large droplet mode, after the formation of the proper large-diameter meniscus in the large-diameter nozzle hole 82, the pressure in the discharge channels 62 is kept at the large-diameter pressure by the water head difference between the supply sub tank 8 and the exhaust sub tank 9, for example.

In the large droplet mode, the volume of the discharge channels 62 is increased and decreased by the method for operating the inkjet head 5 to release the ink from the large-diameter meniscus. Accordingly, a large droplet of the size corresponding to the large-diameter meniscus drops downward. This makes it possible to discharge the large droplet through the nozzle hole 71. In the large droplet mode, a drive voltage of proper frequency is applied to the drive electrodes so that proper large-diameter meniscus can be formed in the large-diameter nozzle hole 82 before and after discharge of the large droplet.

To switch from the large droplet mode to the small droplet mode, the pressure in the discharge channels 62 is decreased to the small-diameter pressure. That is, the supply pump 35 provided in the ink supply tube 31 is stopped to shut off the flow of the ink in the ink supply tube 31. At that time, even though the flow of the ink in the ink supply tube 31 is shut off, the ink is continuously exhausted from the inkjet head 5 by the action of the suction pump 36.

When the insides of the discharge channels 62 are decreased in pressure, the ink charged in the nozzle holes 71 is absorbed into the discharge channels 62. That is, the ink charged in the large-diameter nozzle hole 82 is absorbed into the small-diameter nozzle hole 81 through the lower end opening of the small-diameter nozzle hole 81 to migrate the ink from the large-diameter nozzle hole 82. As illustrated in FIG. 6, the pressure in the discharge channels 62 reaches the small-diameter pressure to form the proper small-diameter meniscus in the small-diameter nozzle hole 81. In the small droplet mode, after the formation of the proper small-diameter meniscus in the small-diameter nozzle hole 81, the pressure in the discharge channels 62 is kept at the small-diameter pressure by the water head difference between the supply sub tank 8 and the exhaust sub tank 9, for example.

The foregoing mode switching may be performed in the entire printer 1 (in all the inkjet heads 5) or may be performed in each of the inkjet heads 5.

As described above, the nozzle plate 51 of the embodiment has the small-diameter nozzle holes 81 and the large-diameter nozzle holes 82 disposed under the small-diameter nozzle holes 81 and communicating with the small-diameter nozzle holes 81.

According to this configuration, discharging the ink from the small-diameter nozzle holes 81 with the small-diameter menisci makes it possible to discharge small droplets. In this case, in the small droplet mode, the print range of one droplet can be made smaller than that in the large droplet mode. Accordingly, setting the drive frequency higher than that in the large droplet mode, for example, makes the pitch of droplets in the Y direction (the scanning direction of the inkjet head 5) narrower than that in the large droplet mode, thereby achieving high-resolution printing. Meanwhile, discharging the ink from the large-diameter nozzle holes 82 with the large-diameter menisci makes it possible to discharge large droplets. In this case, the print range of one droplet can be made larger than that in the small droplet mode, thereby achieving high-speed printing. As described above, the small droplet mode and the large droplet mode can be switched depending on the pressure in the discharge channels 62, thereby changing easily the droplet size of the ink to be discharged from the inkjet heads 5 for different purposes.

In the embodiment, in particular, the small-diameter nozzle holes 81 and the large-diameter nozzle holes 82 communicate with each other in the Z direction. Accordingly, the pitches of the nozzle holes 81 and 82 of the same diameters adjacent to each other in the X direction can be narrower than those of the small-diameter nozzle holes 81 and the large-diameter nozzle holes 82 alternately formed in the X direction, for example. This narrows the pitch of the droplets in the X direction to achieve improvement in the resolution.

In addition, the nozzle plate 51 of the embodiment has the nozzle holes 81 and 82 of the same diameters opened in the same plane. This makes it easier to form the optimum menisci in the nozzle holes 81 and 82 as compared to the case in which a plurality of nozzle holes with different inner diameters is opened in the same plane. Since the optimum menisci can be easily formed in the nozzle holes 81 and 82, it is possible to secure the difference in internal diameter between the small-diameter nozzle holes 81 and the large-diameter nozzle holes 82 and make larger the difference in droplet size between the small droplet mode and the large droplet mode.

In the embodiment, the connection surfaces 76*a* of the first plate 76 are hydrophilic.

According to this configuration, when switching from the small droplet mode to the large droplet mode, the ink outflowing from the small-diameter nozzle holes 81 can be spread into the large-diameter nozzle holes 82. This suppresses the drop of the ink overflowing from the small-diameter nozzle holes 81 directly to the outside through the large-diameter nozzle holes 82 (without spreading onto the connection surfaces 76*a* or the inner surfaces of the large-diameter nozzle holes 82). As a result, the large-diameter nozzle holes 82 can be filled with the ink in the large droplet mode.

In the embodiment, the lower surface of the second plate 77 is water-repellent.

According to this configuration, it is possible to suppress the spread of the ink on the lower surface of the second plate 77. This makes it possible to suppress the leakage of the ink from the large-diameter nozzle holes 82 at the time of switching from the small droplet mode to the large droplet mode, for example.

In the embodiment, the first plate 76 and the second plate 77 are stacked to form the nozzle plate 51.

According to this configuration, after the formation of the small-diameter nozzle holes 81 and the large-diameter nozzle holes 82 in the plates 76 and 77, the plates 76 and 77 are stacked to form the nozzle plate 51. This makes it easier to manufacture the nozzle plate 51 as compared to the case of forming the small-diameter nozzle holes 81 and the large-diameter nozzle holes 82 lining in the Z direction in one nozzle plate.

In the embodiment, the large-diameter nozzle holes 82 (second plate 77) are set to be longer than the small-diameter nozzle holes 81 (first plate 76) in the Z direction.

According to this configuration, the large-diameter menisci can be accommodated in the large-diameter nozzle holes 82. That is, the liquid levels of the large-diameter menisci can be arranged in the large-diameter nozzle holes 82, which suppresses the situation in which the large-diameter menisci cannot be accommodated in the large-diameter nozzle holes 82 and are broken. This makes it possible to formed in the proper large-diameter menisci in the large-diameter nozzle holes 82 in a stable manner.

In addition, the inkjet heads 5 and the printer 1 of the embodiment include the nozzle plate 51 described above, which makes it possible to provide the inkjet heads 5 and the printer 1 with excellent product appeal.

Second Embodiment

Figure 8:
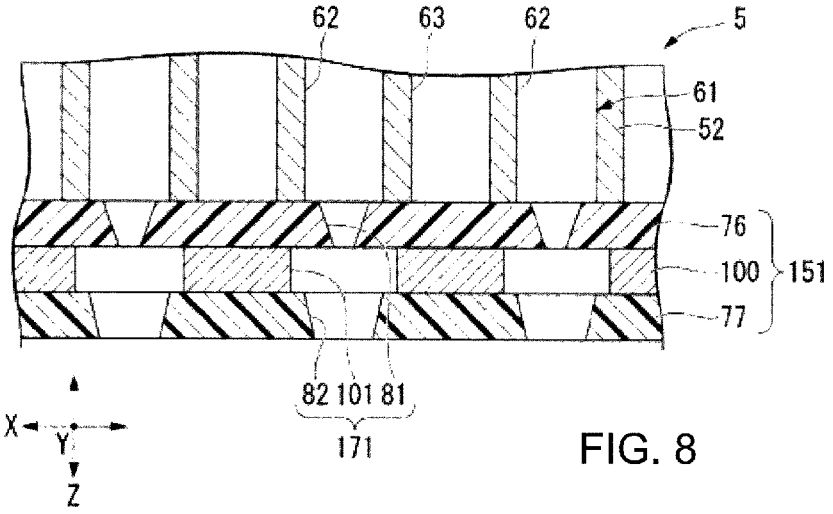
FIG. 8 is a cross-sectional view of an inkjet head according to a second embodiment in correspondence with FIG. 4.

Next, a second embodiment will be described. FIG. 8 is a cross-sectional view of an inkjet head 5 according to a second embodiment in correspondence with FIG. 4. This modification example is different from the foregoing embodiment in that the first plate 76 and the second plate 77 are stacked with an intermediate plate 100 therebetween. Hereinafter, the same components as those of the first embodiment will be given the same reference signs as those of the first embodiment, and descriptions thereof will be omitted.

A nozzle plate 151 illustrated in FIG. 8 has the first plate 76 and the second plate 77 described above and the intermediate plate 100 interposed between the first plate 76 and the second plate 77. The planar-view shape of the intermediate plate 100 is equal to those of the first plate 76 and the second plate 77. In addition, the thickness of the intermediate plate 100 can be changed as appropriate such that the total thickness of the intermediate plate 100 and the second plate 77 falls within the radius of the lower end opening of the large-diameter nozzle hole 82 or more (that is, the maximum recess amount of the large-diameter meniscus in the Z direction or more). Further, the intermediate plate 100 is preferably formed from a metallic material (SUS or the like), for example. However, the thickness, material, and the like of the intermediate plate 100 can be changed as appropriate. For example, the intermediate plate 100 may be formed from the same material as that for the first plate 76 and the second plate 77 (a resin material (for example, polyimide), glass, or the like as well as a metallic material).

The intermediate plate 100 has communication holes 101 penetrating the intermediate plate 100 in the Z direction at positions overlapping the small-diameter nozzle holes 81 and the large-diameter nozzle holes 82 as seen from the Z direction. The communication holes 101 constitute the nozzle holes 171 of the embodiment together with the small-diameter nozzle holes 81 and the large-diameter nozzle holes 82. The communication holes 101 have the inner diameter made entirely uniform in the Z direction, for example. The inner diameter of the communication holes 101 is larger than the inner diameter of the upper end openings of the large-diameter nozzle holes 82. However, the communication holes 101 may be formed in a tapered shape or the like as far as the minimum inner diameter is equal to or more than the inner diameter of the upper end openings of the large-diameter nozzle holes 82.

According to this configuration, the large-diameter menisci can be accommodated in the large-diameter nozzle holes 82 (and in the communication holes 101). That is, the liquid levels of the large-diameter menisci can be arranged in the large-diameter nozzle holes 82 (and in the communication holes 101), which suppresses the situation in which the large-diameter menisci cannot be accommodated in the large-diameter nozzle holes 82 (and in the communication holes 101) and are broken. This makes it possible to formed the proper large-diameter menisci in the large-diameter nozzle holes 82 in a stable manner.

Further, the communication holes 101 allow the lower end openings of the small-diameter nozzle holes 81 and the upper end openings of the large-diameter nozzle holes 82 to communicate with each other, and the communication holes 101 are also filled with the ink in the large droplet mode. In this case, the inner diameter of the communication holes 101 is equal to or more than the inner diameter of the large-diameter nozzle holes 82, and the ink can be smoothly flowed in the large-diameter nozzle holes 82 as compared to the case in which the ink is flown from the small-diameter nozzle holes 81 directly to the large-diameter nozzle holes 82. That is, the communication holes 101 act as buffers for holding the ink between the small-diameter nozzle holes 81 and the large-diameter nozzle holes 82, and it is possible to suppress an insufficient supply of ink into the large-diameter nozzle holes 82 in the large droplet mode.

The technical scope of the present invention is not limited to the foregoing embodiments but can be modified in various manners without deviating from the gist of the present invention.

For example, in the foregoing description of the embodiments, the inkjet printer 1 is taken as an example of a liquid ejection apparatus. However, the present invention is not limited to this configuration. For example, the liquid ejection apparatus may be a facsimile or an on-demand printing machine. In addition, the present invention is also applicable to a large-sized printer without a conveying mechanism for conveying the recording medium P, a head-fixed printer without a scanning mechanism for scanning with the inkjet heads 5, and others.

In foregoing embodiments, the side shoot-type inkjet heads 5 are taken. However, the present invention is not limited to this. For example, the present invention may be applied to edge shoot-type inkjet heads that discharge ink from the ends of the discharge channels 62 along the extending direction.

In the foregoing embodiments, the discharge channels 62 and the non-discharge channels 63 are alternately aligned. However, the present invention is not limited to this configuration. For example, the present invention may be applied to 3-cycle inkjet heads that discharge ink in sequence from all the channels.

In the foregoing embodiments, out of piezo inkjet heads 5, wall bend-type inkjet heads 5 are taken. However, the present invention is not limited to this configuration. For example, the present invention may be applied to, out of piezo inkjet heads, roof shoot-type inkjet heads (the application of pressure to ink and the discharge of droplets are performed in the same direction) and other piezo inkjet heads.

In addition, the present invention is not limited to piezo inkjet heads but is also applicable to thermal inkjet heads and others.

In the foregoing embodiments, the on-carriage printer 1 has the main tanks 6 and the sub tanks 8 and 9. However, the present invention is not limited to this configuration. The present invention may be applied to the printer 1 without the sub tanks 8 and 9 (the ink tanks are loaded on the carriage). In addition, the present invention may be applied to the off-carriage printer 1 in which the ink tanks are installed separately from the carriage 23.

In the foregoing embodiments, switching the operations of the supply pump 35 and the suction pump 36 adjusts the water head difference between the supply sub tank 8 and the exhaust sub tank 9. However, the present invention is not limited to this configuration. For example, a movement mechanism may be provided to move the supply sub tank 8 and the exhaust sub tank 9 relative to each other in the Z direction.

Alternatively, the pressure in the discharge channels 62 may be changed by any method other than the water head difference between the supply sub tank 8 and the exhaust sub tank 9. For example, the supply sub tank 8 may be provided with a pressurizing air pump and the exhaust sub tank 9 may be provided with a depressurization air pump. In this case, the pressure in the discharge channels 62 can be adjusted by adjusting the pressures in the sub tanks 8 and 9 through the operations of the pressurization air pump and the depressurization air pump. Without the sub tanks 8 and 9, the pressure in the discharge channels 62 can be adjusted by adjusting the pressure in the ink tanks provided separately from the carriage 23.

In the foregoing embodiments, the small-diameter nozzle holes 81 and the large-diameter nozzle holes 82 are tapered. However, the present invention is not limited to this configuration. For example, the respective inner diameters of the small-diameter nozzle holes 81 and the large-diameter nozzle holes 82 may be made uniform along the Z direction.

In the foregoing embodiments, the two plates 76 and 77 are stacked to form the nozzle plate 51. However, the present invention is not limited to this configuration. Specifically, the nozzle plate 51 with the small-diameter nozzle holes 81 and the large-diameter nozzle holes 82 may be formed singly (as a single plate). In this case, the nozzle plate can be formed by electroforming or the like. Specifically, electroforming is performed with a molding die having small-diameter molding portions corresponding to the small-diameter nozzle holes to form a primary molded body. Then, the molding die is given large-diameter molding portions corresponding to the large-diameter nozzle holes, and then electroforming is performed again with the molding die. Accordingly, a secondary molded body integrated with the primary molded body is formed. Then, the primary molded body and the secondary molded body are removed from the molding die, thereby completing the nozzle plate in which the primary molded body and the secondary molded body are integrally formed.

In the foregoing embodiments, the two nozzle holes different in inner diameter are lined in the Z direction. However, the present invention is not limited to this configuration. Three or more nozzle holes larger in diameter with increasing proximity to the downstream in the direction of ink flow may be lined in the Z direction.

Moreover, the components of the foregoing embodiments can be replaced with other known components as appropriate without deviating from the gist of the present invention. In addition, the foregoing modification examples may be combined as appropriate.

What is claimed is:

1. An ejection hole plate comprising a plate main body with first ejection holes and second ejection holes configured to eject a liquid, wherein the second ejection holes are larger in diameter than the first ejection holes and communicate with the first ejection holes on a downstream side of the first ejection holes in a direction of liquid flow wherein the plate main body includes:

a first plate having the first ejection holes; and a second plate stacked on a downstream side of the first plate along the flow direction and having the second ejection holes, and wherein the plate main body has an intermediate plate interposed between the first plate and the second plate, the intermediate plate has communication holes configured to allow downstream openings of the first ejection holes along the flow direction and upstream openings of the second ejection holes along the flow direction to communicate with each other, and an inner diameter of the communication holes is equal to or more than an inner diameter of the second ejection holes.

2. The ejection hole plate according to claim 1, wherein the plate main body has hydrophilic connection surfaces configured to connect downstream end edges of the first ejection holes along the flow direction and upstream end edges of the second ejection holes along the flow direction.

3. The ejection hole plate according to claim 1, wherein the plate main body has a water-repellent opening surface provided with downstream openings of the second ejection holes along the flow direction.

4. The ejection hole plate according to claim 1, wherein a length of the second ejection holes along the flow direction is larger than a length of the first ejection holes along the flow direction.

5. A liquid ejection head comprising:

the ejection hole plate according to claim 1; and an actuator plate disposed on an upstream side of the ejection hole plate along the flow direction and having channels configured to communicate with the second ejection holes through the first ejection holes.

6. A liquid ejection apparatus comprising the liquid ejection head according to claim 5.

* * * * *